US005121564A

United States Patent [19]

Story

[11] Patent Number: 5,121,564

[45] Date of Patent: Jun. 16, 1992

[54] CLIP WRAP FOR FIREARM

[76] Inventor: Dennis A. Story, 70 Sunrise Dr., Hollister, Calif. 95023

[21] Appl. No.: 636,636

[22] Filed: Dec. 31, 1990

[51] Int. Cl.[5] ..... F41C 27/00; F42B 39/02

[52] U.S. Cl. ..... 42/90; 224/239

[58] Field of Search ..... 42/71.01, 74, 87, 88, 42/90, 96; 224/223, 235, 239, 228, 251

[56] References Cited

U.S. PATENT DOCUMENTS

| | | | |
|---|---|---|---|
| 214,823 | 4/1879 | Hopkins | 224/218 |
| 1,199,635 | 9/1916 | Urmston | 224/218 |
| 1,326,016 | 12/1919 | Batchelder | 224/222 |
| 1,338,797 | 4/1920 | Sullivan | 224/222 |
| 1,562,641 | 11/1925 | Hodgson | 224/218 |
| 2,605,033 | 7/1952 | Terry | 42/71.01 |
| 4,299,343 | 11/1981 | Atchisson | 224/149 |
| 4,773,576 | 9/1988 | Moravek | 224/251 |
| 4,860,478 | 8/1989 | Clayton | 224/239 |
| 4,860,479 | 8/1989 | Easter | 42/96 |

*Primary Examiner*—Charles T. Jordan
*Attorney, Agent, or Firm*—Townsend and Townsend

[57] ABSTRACT

The present invention provides an ammunition clip holder or clip wrap which is carried by a flexible panel or sheet-like body. The body can be formed into a sleeve and this sleeve can be wrapped around and removably secured to the stock of a firearm, such as a rifle. The body thus forms the base of a clip holder which is substantially stationary on the stock. The clip wrap or holder has at least a pair of pocket units with front openings at the front ends thereof to receive and hold ammunition clips. Straps are provided to removably close the front openings of the pocket units to retain the clips therein until the clips are to be pulled out of the pocket units and used in the firearm. The body of the clip wrap can be of any suitable heavy duty material, such as flexible nylon material. Moreover, Velcro strips can be used to hold the body of the clip wrap in a sleeve-like configuration on the stock of a firearm. Thus, the sleeve will be retained on the stock. Removal of the sleeve from the stock requires only that the Velcro strips be separated from each other to thereby open the sleeve.

7 Claims, 1 Drawing Sheet

CLIP WRAP FOR FIREARM

This invention relates to improvements in the handling and storing of ammunition in or on clips and, more particularly, to a device for holding at least a pair of ammunition clips on the stock of a firearm so that the clips are readily accessible while using the firearm.

BACKGROUND OF THE INVENTION

In using a rifle or other firearm, it is desirable to have the cartridges or ammunition of the firearm close at hand. Thus, the ammunition can be readily placed in the firearm and fired without having to perform other time consuming steps.

Prior U.S. patents pertinent to this general subject matter include the following:

| | |
|---|---|
| 214,823 | 1,562,641 |
| 1,199,635 | 4,299,343 |
| 1,326,016 | 4,773,576 |
| 1,338,797 | 4,860,478 |

For the most part, the ammunition holders of the above mentioned patents have one or more drawbacks. Thus, improvements in the way ammunition holders are used are needed. The present invention has been developed to solve some of the problems posed by the structures of the foregoing patents; thus, the present invention satisfies certain needs for improved clip wraps for holding clips of ammunition on a firearm.

SUMMARY OF THE INVENTION

The present invention provides an ammunition clip holder or clip wrap which is carried by a flexible panel or sheet-like body. The body can be formed into a sleeve and this sleeve can be wrapped around and removably secured to the stock of a firearm, such as a rifle. The body thus forms the base of a clip holder which is substantially stationary on the stock. The clip wrap or holder has at least a pair of pocket units with front openings at the front ends thereof to receive and hold ammunition clips. Straps are provided to removably close the front openings of the pocket units to retain the clips therein until the clips are to be pulled out of the pocket units and used in the firearm.

The body of the clip wrap can be of any suitable heavy duty material, such as flexible nylon material. Moreover, Velcro strips can be used to hold the body of the clip wrap in a sleeve-like configuration on the stock of a firearm. Thus, the sleeve will be retained on the stock. Removal of the sleeve from the stock requires only that the Velcro strips be separated from each other to thereby open the sleeve.

The primary object of the present invention is to provide an improved clip holder for at least a pair of ammunition clips wherein the holder can be formed in the shape of a sleeve removably attachable to the stock of a firearm to thereby permit the clips to be quickly and easily removed from pocket units on the sleeve through front openings.

Other objects of the present invention will become apparent as the following specification progresses, reference being had to the accompanying drawings for an illustration of the invention.

IN THE DRAWINGS

FIG. 1 is a perspective view of the clip wrap of the present invention, showing the clip wrap mounted in the form of a sleeve on the stock of a firearm, such as a rifle, and illustrating one of a pair of clip-receiving pocket units mounted on the sleeve; and FIG. 2 is a top plan view of the clip wrap of FIG. 1, showing the clip wrap in an open, flattened condition and showing the relative positions of the two clip-receiving pocket units on the clip wrap.

DETAILED DESCRIPTION OF THE DRAWINGS

Figure 1:
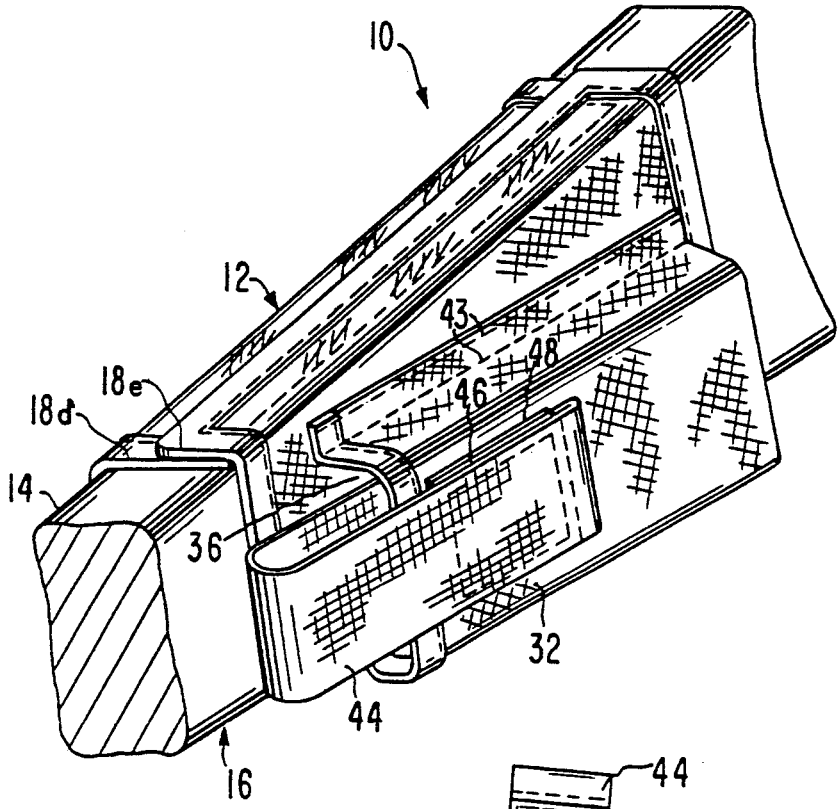

The clip wrap or clip holder of the present invention is broadly denoted by the numeral 10 and comprises a device having a flexible body 12 which is adapted to be wrapped on or otherwise coupled to the stock 14 of a firearm 16, such as a rifle. Only the stock 14 of the rifle is shown for purposes of simplifying the drawing. However, it is to be understood that the stock is coupled to a bullet firing mechanism and a barrel as is well known.

Body 10 is formed from a sheet 18 of heavy duty, abrasion resistant material, such as nylon which can be stitched. Sheet 18 has a V-shape as shown in FIG. 2 to present a pair of halves or half members 18*a* and 18*b* which, when folded along an imaginary center line 18*c* and when the side margins 18*d* and 18*e* overlap as shown in FIG. 1, will form a sleeve which fits around the stock 14 in the manner shown in FIG. 1.

Figure 2:
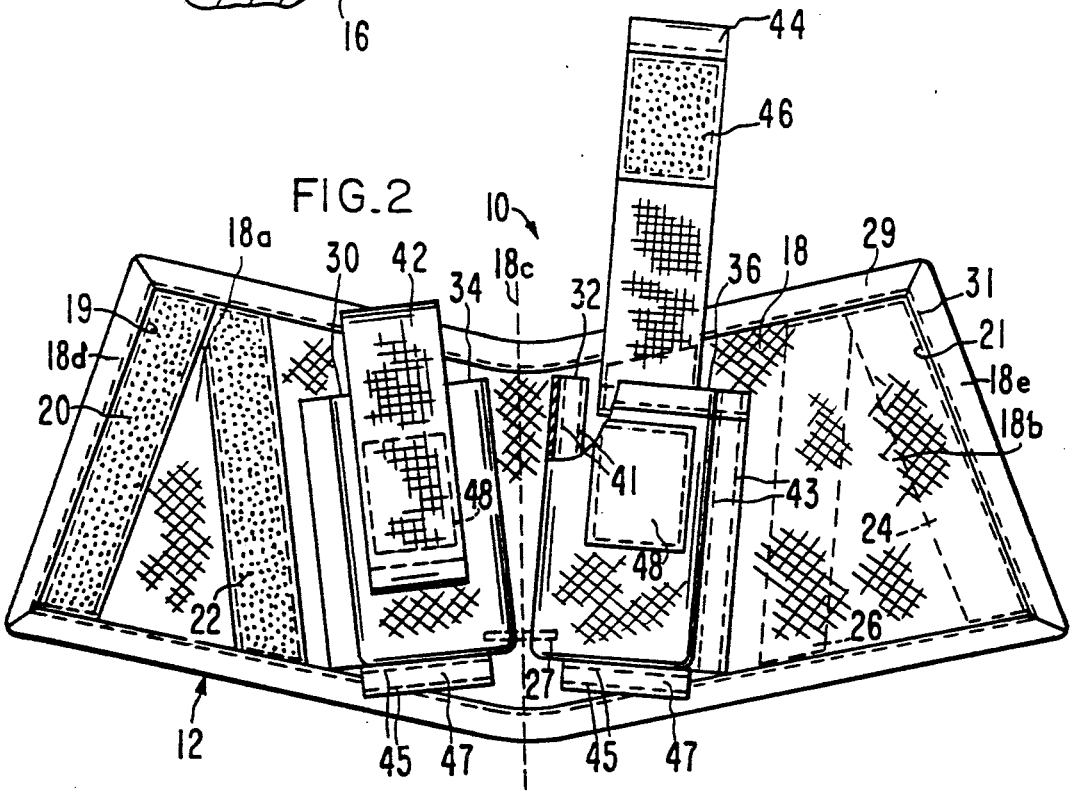

To form the sleeve and to releasably attach the sleeve to the stock as shown in FIG. 1, body 12 has a number of Velcro strips attached thereto in spanning relationship to the width of the body as shown in FIG. 2. For instance, a first pair of Velcro strips 20 and 22 are secured, such as by stitching 19, to one face of member 18*a* with strips 20 and 22 being at an angle of about 10 to 20 degrees to each other. Similarly, on the opposite face of member 18*b*, a second pair of Velcro strips 24 and 26 complementary to strips 20 and 22 are secured, such as by stitching 21. Thus, when the body 12 is folded along center line 18*c* and the body is wrapped around the stock as shown in FIG. 1, Velcro strip 24 will move into coupled relationship with Velcro strip 22, and Velcro strip 26 will move into coupled relationship with Velcro strip 20. The body will then form a sleeve which fits snugly around the stock 14. The sleeve cannot move to the right when viewing FIG. 1 because the stock increases in height. The sleeve will not move to the left when viewing FIG. 1 because there is sufficient friction between the inner surface of the sleeve and the outer surface of the stock to prevent any substantial movement of the sleeve. In addition, for a firearm equipped with a sling loop, a reinforced buttonhole 27 (FIG. 2) is provided in the body of the clip wrap which fits over the sling loop. Thus, the sleeve is prevented from moving to the left when viewing FIG. 1. The buttonhole 27 is shown in FIG. 2 as being intersected by the center line 18*c* and the buttonhole is near the rear ends of the pocket units 30 and 32 to be described.

Body 12 is preferably reinforced with a strip 29 of nylon or other fabric which is folded upon itself. Strip 29 extends about the outer periphery of body 12 and is stitched thereto along a stitch line 31.

A pair of pocket units 30 and 32 are secured to the outer surfaces of respective members 18*a* and 18*b* as shown in FIG. 2. Pocket units 30 and 32 have front end openings 34 and 36 to receive ammunition clips (not shown). Openings 34 and 36 can be closed by straps 42 and 44.

Each pocket unit 30 or 32 is formed from a sheet or panel of suitable flexible material, such as heavy duty nylon. The material can be stitched at side margins to body 12. Stitch lines 41 and stitch lines 43 are provided in the side margins of each of the units 30 and 32 to secure the same to body 12. Similarly, stitch lines 45 secure end flaps 47 to couple the bottoms or the rear ends of the pocket units to the body 12 to close the rear ends of the pocket units and limit the extent to which clips can be forced into the pocket units 30 and 32.

Straps 42 and 44 of flexible nylon or other fabric capable of being stitched are secured in any suitable manner, such as stitching to body 12. The straps are provided for closing the front end openings 34 and 36 of pocket units 30 and 32. Velcro pads 46 and 48 are provided for releasably holding the straps 42 and 44 in closing relationship to the front end openings 34 and 36 of the pocket units as shown in FIG. 1.

In use, clip wrap 10 is first placed on the stock 14 of the firearm 16 in the manner shown in FIG. 1. Clips of ammunition can then be placed in the pocket units 30 and 32, and straps 42 and 44 can be moved into their closing positions as shown in FIG. 1, clip unit 30 being omitted from FIG. 1 for purposes of simplifying the drawings.

When it is desired to remove a clip from a pocket unit 30 or 32, the strap 42 or 44 of the pocket unit is moved to an open position and the clip is removed from the forward end of the corresponding pocket unit. The clip can then be placed into the firearm for firing. When it is desired to cease firing and to store the firearm, clip wrap 10 can be removed from the stock 14 by separating Velcro strips 20 and 24 from each other and Velcro strips 22 and 26 from each other, whereby clip wrap 10 can be stored adjacent to the firearm or can be left on the firearm in the manner shown in FIG. 1 if desired.

I claim:

1. A holder for ammunition clips for use with a firearm having a stock with the stock having a longitudinal axis comprising:

a sheet-like body of flexible material, said body adapted to be wrapped on the stock of a firearm to form a sleeve with the body having quick release fastening means for coupling the sleeve on the stock in a generally fixed position; and at least one elongated pocket unit on the body, the pocket unit adapted to receive an ammunition clip and having a pair of spaced ends, the pocket unit extending longitudinally of the stock when the sleeve is coupled to the stock, one end of the pocket unit being in front of the other end of the pocket unit and having a front opening for receiving the clip when the sleeve is coupled to the stock.

2. A holder as set forth in claim 1, wherein a strap is included for removably holding an ammunition clip in the pocket unit.

3. A holder as set forth in claim 1, wherein a panel is included and stitched at the side margins thereof to the body and spaced outwardly therefrom to present said pocket unit.

4. A holder for ammunition clips for use with a firearm having a stock comprising:

a sheet-like body of flexible material, the body has a generally V-shape to present a pair of members on opposite sides of an imaginary center line, said body adapted to be wrapped on the stock of a firearm to form a sleeve with the body having means for coupling the sleeve on the stock in a generally fixed position, said coupling means including a first pair of Velcro strips on one side of the said center line and a second pair of Velcro strips on the opposite side of the center line, one set of Velcro strips being on one face of the body and the other set of Velcro strips being on the opposite face of the body near the opposite side thereof, whereby the first and second sets of Velcro strips will mate with each other to couple the members together to form the sleeve when the body is wrapped about the stock of the firearm; and at least one pocket unit on the body, the pocket unit adapted to receive an ammunition clip, and the pocket unit having a front opening for receiving the clip near the front end of the sleeve when the sleeve is coupled to the stock.

5. A holder as set forth in claim 4, wherein the Velcro strips are stitched to the body.

6. A holder as set forth in claim 4, wherein the strips of Velcro on each side, respectively, of the center line being at an acute angle with respect to each other.

7. A holder as set forth in claim 4, wherein a pocket unit is provided on the outer surface of each member, respectively.

* * * * *